US005108777A

United States Patent [19]

Laird

[11] Patent Number: 5,108,777

[45] Date of Patent: Apr. 28, 1992

[54] ELECTROSTATIC FLOCKING METHOD

[75] Inventor: William F. Laird, Kingston, Canada

[73] Assignee: Microfibres, Inc., Pawtucket, R.I.

[21] Appl. No.: 621,371

[22] Filed: Nov. 30, 1990

[51] Int. Cl.[5] ..... B05D 1/16

[52] U.S. Cl. ..... 427/8; 427/26; 427/32

[58] Field of Search ..... 427/25, 26, 8, 32

[56] References Cited

U.S. PATENT DOCUMENTS 2,376,922 5/1945 King ..... 118/640 X
2,881,087 4/1959 Schwartz et al. ..... 427/25
3,698,357 10/1972 Spencer ..... 118/636
3,944,693 3/1976 Ungerer ..... 427/201 X
4,091,764 5/1978 Brennenstuhl ..... 427/25 X

*Primary Examiner*—Evan Lawrence
*Attorney, Agent, or Firm*—Wolf, Greenfield & Sacks

[57] ABSTRACT

An AC electrostatic flocking method having a variable frequency alternating electrostatic field that optimizes flocked product characteristics and/or processing efficiency. The optimized frequency can be determined on-line or from a chart or computerized database containing pre-determined optimized frequencies. The optimized frequency varies depending upon the precursors used and the processing conditions and parameters. Multiple in-line flocking modules having alternating variable frequency electrostatic fields operating at different frequencies may be utilized.

15 Claims, 2 Drawing Sheets

ELECTROSTATIC FLOCKING METHOD

FIELD OF INVENTION

The present invention relates to a method of applying flock to a substrate and, more particularly, relates to a variable frequency alternating current electrostatic flocking method.

BACKGROUND OF THE INVENTION

Flocking involves the embedding of a short length of filament fiber, called flock, in an adhesive layer covering a fabric substrate. A wide range of natural and synthetic fibers can be used as flock including rayon, cotton, nylon, and polyester.

Flock is traditionally applied by three main methods; mechanical flocking, direct current electrostatic flocking and alternating current electrostatic flocking. In mechanical flocking, the flock fibers sift down onto a coated substrate that is simultaneously subject to a vigorous beating on its underside. The beating causes the substrate to vibrate which in turn causes the flock fibers to orient vertically and embed in the adhesive.

AC and DC electrostatic flocking use high voltages in the range of 30,000 volts to 120,000 volts. In both electrostatic methods, flock fibers are delivered from a hopper into the electrostatic field. The flock fibers receive a positive charge from the electrostatic field (alternating with a negative charge in AC electrostatic flocking) and are driven into the neutrally or ground potential charged adhesive coating.

Attempts have been made by the AC electrostatic flocking art to improve production speeds, pile density, and surface uniformity, as well as to reduce the amount of unattached or excess flock accumulating during fabrication. To this end, modifications have been made to the shape and size of the electrostatic grids, the electrostatic finish on the fiber and the composition of the adhesive. No attention, however, has been directed towards adjusting the frequency of the alternating electrostatic field. AC flocking is conventionally operated at 60 Hz. U.S. Pat. No. 2,376,922 discloses that 25 Hz and other frequencies will provide satisfactory results; no prior art teaching, however, teaches or suggests selectively adjusting the frequency of the alternating electrostatic field to accomplish the aforementioned objectives.

SUMMARY OF THE INVENTION

The present invention includes a method of AC electrostatic flocking. An adhesive-coated substrate is positioned relative to a hopper or other means of dispensing the flock. An alternating electrostatic field is created between electrostatically charged grids and the substrate. The frequency of the alternating electrostatic field is selectively adjusted to optimize physical characteristics of the flocked material formed thereby and/or to optimized the flocking procedure quality and speed. In one important embodiment of the invention, the flock is dispensed into a high voltage (50 kvolts) alternating electrostatic field having a selected first frequency. The high voltage provides sufficient power to drive the flock into the substrate. The resulting flocked substrate is examined and the frequency of the alternating electrostatic field is then adjusted upwards or downwards to optimize the ability of the flock to receive the electrostatic charge which in turn optimizes the physical characteristics of the resulting flocked material including flocked density and flock orientation and/or the efficiency of the flocking process. In another important embodiment of the invention, the flock is dispensed from at least two in-line flocking modules; the first flocking module having a frequency higher than the frequency of the second and any subsequent flocking modules. In another important embodiment, the frequency of the alternating electrostatic field is pre-determined based upon certain physical characteristics of the materials used to form the desired flock substrate.

Accordingly, it is a primary object of the present invention to provide a method for improving the manufacture of AC electrostatically flocked materials.

It is another abject of the present invention to improve the efficiency of AC electrostatic flocking methods.

It is another object of the present invention to provide an improved method of AC electrostatic flocking.

BRIEF DESCRIPTION OF THE DRAWINGS

These and other details and advantages of the invention will be described in connection with the accompanying drawing in which.

DESCRIPTION OF THE PREFERRED EMBODIMENT

The present invention of AC electrostatic flocking utilizes an optimum frequency of an alternating current electrostatic field to electrostatically drive the flock into an adhesive coated substrate. By "optimum" frequency, Applicant means a frequency that, as compared to the results obtained at 60 Hz or other starting frequency, provides improvements in flock product characteristics, i.e., pile density, surface appearance, pile uniformity, etc., or improvements in the flocking method efficiency, i.e., line speed, reduction in formation of excess flock, etc. It is expected for a particular application that a range of frequencies, as opposed to a single frequency, will satisfy the foregoing definition of "optimum" frequency. For example, a frequency of 30 Hz may provide better pile density than a frequency of 40 Hz for a particular flocked material; nonetheless, because the products of the 30 Hz and 40 Hz processes each possess better pile density than that obtained at 60 Hz, both the 30 Hz and 40 Hz are optimum frequencies for the purposes of this patent.

Many variables affect the flocking efficiency of AC electrostatic methods including the cleanliness of the fiber prior to application of the electrostatic finish, the type of electrostatic finish and uniformity of coating thereof on the flock fiber, the moisture level in the coated flock and the ratio of fiber length to diameter. Each of the foregoing factors affects the ability of the flock to accept the AC electrostatic charge. Applicant has determined that a fiber that does not efficiently accept a charge at 60 Hz may operate well if the frequency is adjusted upwards or downward. At a lower cycle, for example 50 Hz, the fiber can optimally accept the charge and fire into the adhesive coated substrate. Tests by Applicant have shown that certain fibers which cannot be efficiently flocked at 60 Hz can be fabricated with commercially acceptable appearance and at suitable operating speeds by adjusting the frequency of the alternating electrostatic field between 10 cycles per second all the way up to 120 Hz.

Figure 1:
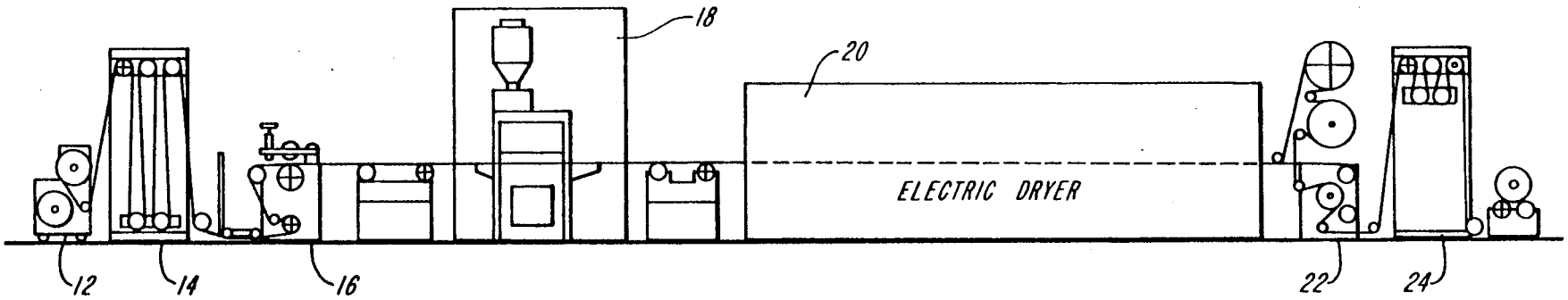
FIG. 1 is a schematic view of the method of electrostatic flocking according to the preferred embodiment of the invention.

A schematic of the method according to the preferred embodiment is shown in FIG. 1. A let-off 12 supplies the substrate of fabric or other material which is accumulated at station 14. The top side of the horizontally disposed substrate is covered with adhesive at the coating station 16. The coated substrate passes through a flocking module 18 where flock is dispensed evenly from side-to-side across the adhesive coating. The module preferably includes a long perforated insulated screen or grid that extends across the direction of movement of the substrate. Flock fibers are deposited onto the screen and a brush forces fibers therethrough. The insulated grid is maintained at approximately 50,000 volts AC and at an optimum frequency is positioned below the screen. The coated substrate is maintained at ground potential. The fibers enter the AC electrostatic field where they receive the electrostatic charge and are driven down into the coated substrate where they become implanted in and eventually adhere to the adhesive coating. The alternating electrostatic field raises loose and poorly planted fibers from the fabric substrate and reembeds them during each charge/discharge cycle. The flock align themselves in the direction of the electrostatic field lines and therefore maintain a non-random orientation relative to the substrate. A dryer operation 20 dries and cures the adhesive layer. Excess flock is removed in the vacuum and brushing station 22. A wind-up and accumulator station 24 rolls up the flocked substrate.

The optimum frequency can be determined by examination of the flocked product on the line, visually and/or with a beta gauge, and then adjusting the AC electrostatic field upwards or downwards based upon the pile density, surface uniformity, pile appearance, etc. of the sampled product. For example, if the sampled product has poor pile density, the operator would likely decrease the frequency of the electrostatic field to give the flock a better opportunity to accept the electrostatic charge. On the other hand, if pile disturbance were noted, the operator might increase the frequency of the electrostatic field to provide better surface uniformity. Even where acceptable physical characteristics are observed, the operator may still adjust the frequency of the electrostatic field. Applicant has determined that lower cycles provide faster flock weight accumulation and quicker lines speeds for certain fiber and adhesive combinations. The operator would sample a preliminary run at 50 Hz; if the product characteristics are acceptable, the operator would nonetheless lower the alternating field frequency until pile disturbance or other unacceptable product characteristic is observed. The operator would then raise the frequency until the defect disappears. Production would then ensue at the last adjusted frequency which is lower than the starting frequency.

The foregoing procedure for adjusting the frequency is inherently subjective based upon the ability of the particular operator to gauge product quality. It is also time-consuming as it may require the operator to repeatedly halt production, test samples and adjust the alternating electrostatic field frequency until an optimum frequency is found. Uniformity in processing can be achieved by having the operator refer to a prerecorded chart containing the optimum frequency for frequently encountered precursor variables as well as desired flock material and beta gauge specifications. Combinations of some or all of the following influential precursor variables and flock material specifications are compiled together with the appropriate optimum frequency for such combinations: fiber type, fiber size, quality of fiber scouring, type of adhesive, thickness of adhesive coating, uniformity of electrostatic finish, and desired pile density.

The pre-determined optimum frequency may be derived from past production experience or by extrapolation from previously determined optimum frequencies for similar variables. Prior to the flocking operation, the operator makes the necessary measurements or examinations of the precursor materials and then uses the chart to determine the range of frequencies which will optimize product quality and/or processing for the particular variables being encountered. The production starts with the flocking module set at the pre-determined optimum frequency. Adjustments to the predetermined optimum frequency can be made on-line by the operator to further improve the quality of the flocked material being produced as well as to improve the operating efficiency.

Further advantageous would be a software program which contains a database of the differing variable combinations and associated optimum frequencies. The production line operator would be prompted by a computer to input the variable information; the program would digest this information, compare it to the stored database and then display the optimum frequency to the operator. The operator would then adjust the frequency of the alternating electrostatic field within the range suggested by the computer. Further advantageous would be circuitry connected between the computer and the controller for the alternating electrostatic field that permits automatic adjustment of the field frequency in response to the optimum frequency output of the computer.

Figure 2:
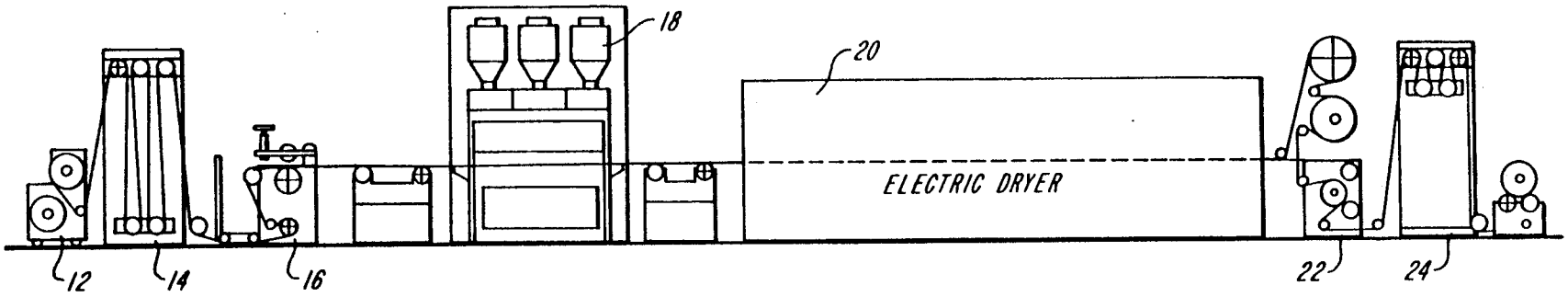
FIG. 2 is a schematic view of an alternative embodiment of the invention incorporating multiple flocking modules.

An alternative three-module line is shown in FIG. 2 and would work as follows. First, the operator determines the lowest frequency that can be utilized without encountering pile disturbance, for example 50 Hz. The following two modules are then set at much lower operating cycles, such as 10–20 Hz. The second and third modules can be set at the same frequency or different frequency depending upon the peculiar variables encountered. The flocking process follows the same procedure as described with respect to the single module shown in FIG. 1. The only difference being that the flock is dispensed and electrostatically driven into the adhesive coated substrate by three adjacent stands as opposed to by one single stand. Preferably, as much flock as possible is driven into the substrate by each of the modules; the throughput of the downstream modules being limited by the flock density applied in the upstream modules. The foregoing three module embodiment has been used to flock fibers that would not adequately perform in standard 60 Hz single flocking modules. Applicant has also found that flocked materials conventionally fabricated at 60 Hz and 60 ft/min line speeds are formed of similar quality at line speeds of 80–90 ft/min in a three module production line similar to the embodiment described above.

It is understood that the preceding description is given merely by way of illustration and not in limitation of the invention and that various modifications may be made thereto without departing from the spirit of the invention.

What is claimed is:

1. A method for applying flock fibers to a substrate comprising:
   moving the substrate relative to a supply of flock fibers;
   dispensing the flock fibers relative to the substrate;
   determining an optimum frequency of an alternating electrostatic field; and
   subjecting the dispensed flock fibers to an alternating electrostatic field having the determined optimum frequency to deposit the dispensed flock fibers into the substrate.

2. The method as recited in claim 1, wherein said optimum frequency is in the range between 10 and 120 Hz.

3. The method as recited in claim 1, wherein said determining step includes the steps of:
   subjecting a portion of the dispensed flock fibers to an alternating electrostatic field having a frequency of 60 Hz;
   examining the flocked material produced by the 60 Hz alternating electrostatic field; and
   adjusting, upwards or downwards, the frequency of the alternating electrostatic field.

4. The method as recited in claim 1, wherein said determining step includes the step of referring to a chart containing pre-determined optimum frequencies for particular combinations of flocked material and/or processing variables.

5. The method as recited in claim 1, wherein said determining step includes the steps of inputting product precursor and/or processing variables into a computer having a database of flocked material and/or processing variables and the optimum frequencies for combinations thereof, the computer having software for displaying the optimum frequencies for the inputted variables.

6. A method for applying flock fibers to a substrate comprising:
   moving the substrate relative to a supply of flock fibers;
   dispensing the flock fibers relative to the substrate;
   subjecting the dispensed flock fibers to an alternating electrostatic field having a first frequency to deposit the dispensed flock fibers into the substrate; and
   adjusting the frequency of the alternating electrostatic field to an optimum frequency.

7. The method as recited in claim 6 further comprising the step of subjecting further dispensed flock fibers to an alternating electrostatic field at the optimum frequency.

8. A method of applying flock fibers to a substrate comprising:
   determining an optimum frequency of an alternating electrostatic field;
   positioning the substrate relative to a supply of flock;
   apply an alternating electrostatic field having the optimum frequency between the substrate and the supply of flock;
   and dispensing the flock relative to the substrate to deposit the dispensed flock into the substrate.

9. A method of applying flock to a substrate comprising:
   positioning the substrate relative to a first module for dispensing flock;
   dispensing flock from the first module relative to the substrate;
   subjecting the dispensed flock from the first module to an alternating current electrostatic field having a first optimum frequency to deposit the dispensed flock into the substrate;
   positioning the substrate relative to a second module for dispensing flock;
   dispensing flock from the second module relative to the substrate; and
   subjecting the dispensed flock from the second module to an alternating current electrostatic field having a second optimum frequency to deposit the dispensed flock into the substrate.

10. The method as recited in claim 9, wherein the second optimum frequency is less than the first optimum frequency.

11. The method as recited in claim 9, wherein the second optimum frequency and the first optimum frequency are equal.

12. The method as recited in claim 9, wherein the second optimum frequency is greater than the first, optimum frequency.

13. The method as recited in claim 9, wherein the first optimum frequency is less than 60 Hz but greater than the frequency sufficient to cause pile disturbance of the flocked substrate.

14. The method as recited in claim 13, wherein the second optimum frequency is in the range between 10 Hz and the frequency sufficient to cause pile disturbance of the flocked substrate at the first optimum frequency.

15. The method as recited in claim 13, wherein the second optimum frequency is in the range between 10 Hz and 20 Hz.

* * * * *